US011585186B2

(12) United States Patent
Coyes et al.

(10) Patent No.: US 11,585,186 B2
(45) Date of Patent: Feb. 21, 2023

(54) STANDING VALVE ASSEMBLY AND RELATED SYSTEMS FOR DOWNHOLE RECIPROCATING PUMP

(71) Applicant: Q2 Artificial Lift Services ULC, Red Deer, CA (US)

(72) Inventors: Corbin Coyes, Red Deer (CA); Curtis Paterson, Red Deer (CA); Garth John Fraser, Red Deer (CA)

(73) Assignee: Q2 Artificial Lift Services ULC, Red Deer (CA)

( * ) Notice: Subject to any disclaimer, the term of this patent is extended or adjusted under 35 U.S.C. 154(b) by 0 days.

(21) Appl. No.: 17/339,050

(22) Filed: Jun. 4, 2021

(65) Prior Publication Data

US 2021/0381338 A1 Dec. 9, 2021

Related U.S. Application Data

(60) Provisional application No. 63/035,466, filed on Jun. 5, 2020.

(51) Int. Cl.
*E21B 34/08* (2006.01)

(52) U.S. Cl.
CPC ..... *E21B 34/08* (2013.01); *E21B 2200/04* (2020.05)

(58) Field of Classification Search
CPC ..... E21B 43/126; E21B 43/127; E21B 43/13; E21B 33/00; E21B 34/08; E21B 2200/04; F04B 4/02; F16K 2200/502
See application file for complete search history.

(56) References Cited

U.S. PATENT DOCUMENTS

| | | | | |
|---|---|---|---|---|
| 10,077,629 | B2 | 9/2018 | Ford | |
| 10,100,609 | B2 | 10/2018 | Ford | |
| 10,100,829 | B2 | 10/2018 | Ford | |
| 10,914,148 | B2 | 2/2021 | Rich | |
| 2005/0257927 | A1* | 11/2005 | Coyes | F04B 47/02 166/325 |
| 2017/0058635 | A1* | 3/2017 | Downing | F04B 47/02 |
| 2018/0066652 | A1* | 3/2018 | Ford | F04B 53/04 |

OTHER PUBLICATIONS

Examiner's Report in Canadian Application No. 3,121,080 dated Oct. 21, 2021, 5 pages.

* cited by examiner

*Primary Examiner* — George S Gray
(74) *Attorney, Agent, or Firm* — Smith Baluch LLP

(57) ABSTRACT

A standing valve assembly comprises a flow cage, a ball seat, and a valve ball. The flow cage includes a cage body defining an axial fluid passage therethrough, and a bridge extending across the fluid passage. The cage body and the bridge collectively define a plurality of openings to the fluid passage. The valve ball is received between the bridge and the ball seat and is axially movable within the flow cage. The bridge has an upper face and defines at least one guide ramp in the upper face. Each guide ramp extends at a downward angle to a respective one of the plurality of openings.

20 Claims, 9 Drawing Sheets

STANDING VALVE ASSEMBLY AND RELATED SYSTEMS FOR DOWNHOLE RECIPROCATING PUMP

RELATED APPLICATION

The present application claims priority to U.S. Provisional Patent Application Ser. No. 63/035,466 filed Jun. 5, 2020, the entire contents of which are incorporated herein by reference.

FIELD OF THE DISCLOSURE

The present disclosure relates to artificial lift systems such as reciprocating downhole pumps. More particularly, the present application relates to valve assemblies for reciprocating downhole pumps.

BACKGROUND

In hydrocarbon recovery operations, an artificial lift system is typically used to recover fluids from a well in a subterranean earth formation. Common artificial lift systems include reciprocating pumps such as sucker rod pumps. The pump may generally comprise a plunger disposed within a barrel and a valve system. The plunger is moved up and down within the barrel in order to draw fluids to the surface. More particularly, the plunger may be coupled to a lower end of a reciprocating rod or rod string, for example. The rod string may be referred to as a "sucker rod."

The valve system may include a standing valve and a travelling valve. The standing valve may be positioned at the bottom of the barrel, and the travelling valve may be coupled to a bottom end of the plunger. On the downstroke, pressure differentials may close the standing valve and open the travelling valve. Fluids in the barrel may thereby pass upward through the travelling valve and plunger during the downstroke. On the upstroke, reversed pressure differentials may close the travelling valve and open the standing valve. Fluids above the travelling valve maybe moved upward by motion of the plunger, and fluids from the earth formation or reservoir may enter the barrel (below the plunger) via the standing valve.

The standing valve and the travelling valve may each be a respective ball check valve. A ball check valve may comprise a ball in a flow cage that can move between a first position in which flow is blocked and a second position in which fluid may flow through the cage. Typically, in a flow blocking position, the valve ball sits on a ball seat (such as a ring) and blocks fluid flow through an opening (hole) in the ball seat. It may be desired for one or both of the standing and travelling valves to be held open for fluid, liquid, gas, or steam to pass through. By way of example, both valves may be held open for draining of fluids and/or insertion of steam or other fluids. One method of opening a standing valve, for example, is by lowering a tool with a "spoon bill" or "probe" such that the probe is inserted into the standing valve flow cage to mechanically unseat the valve ball.

The probe must pass through an opening in the standing flow cage to engage the ball. However, the probe may be misaligned and instead strike the top of the flow cage, potentially being blocked from engaging the ball and/or causing damage to the flow cage. In this situation, a rig or other equipment such as a flushby may be needed at the wellhead to pull back the probe, align the probe with an opening of the cage, and re-lower the probe. The rig may, for example, may need to turn the pump sucker rods to align the probe.

Another potential problem of conventional standing valve assemblies is vibration and lateral movement of a valve ball within the standing valve flow cage during production. While the valve ball is unseated (e.g., during the upstroke) fluid flow forces through the flow cage may cause the valve ball to vibrate within the flow cage, thereby causing or accelerating wear of the flow cage and/or ball.

SUMMARY

According to an aspect, there is provided a standing valve assembly for a downhole artificial lift system, the assembly comprising: a flow cage comprising: a cage body defining an axial fluid passage therethrough; and a bridge extending across the fluid passage, the cage body and the bridge collectively defining a plurality of openings to the fluid passage; a ball seat spaced from and positioned below the bridge; and a valve ball within the fluid passage and positioned between the ball seat and the bridge, the valve ball being removably seatable on the ball seat, wherein the bridge has an upper face and defines at least one guide ramp in the upper face, each guide ramp extending at a downward angle to a respective one of the plurality of openings.

In some embodiments, the cage body comprises a tubular body, and the fluid passage comprises an axial bore through the tubular body.

In some embodiments, the tubular body has an inlet end and an outlet end, the bridge extends across the fluid passage proximate the outlet end, and the ball seat is positioned proximate the inlet end.

In some embodiments, the inlet end of the tubular body is a lower end of the tubular body, and the outlet end of the tubular body is an upper end of the tubular body.

In some embodiments, the ball seat and the bridge are spaced to allow limited axial movement of the valve ball, the bridge being an upper stop for the valve ball and the ball seat being a lower stop.

In some embodiments, the tubular body has an inner surface and an outer surface, and tubular body defines a plurality of ports extending from the inner surface to the outer surface.

In some embodiments, the plurality of ports comprise at least a first port and a second port opposite to the first port.

In some embodiments, each of the first and second ports has an elliptical or oblong profile that is elongated in a direction angled relative to a longitudinal axis of the flow cage.

In some embodiments, each of the plurality of ports is elongated along a respective helical path.

In some embodiments, the ball seat defines a hole therethrough, the valve ball blocking flow through the hole when seated.

In some embodiments, the bridge comprises a beam having opposite first and second ends connected to the cage body.

In some embodiments, the at least one guide ramp comprises a first guide ramp at the first end of the bridge and a second ramp at the second end of the bridge.

In some embodiments, each at least one guide ramp is angled to guide a probe toward a respective one of the opening.

In some embodiments, the standing valve assembly further comprises a stem extending upward from the upper end of the flow cage.

According to another aspect, there is provided a system for a downhole reciprocating pump comprising: the standing valve assembly described herein; a travelling valve assembly comprising a second valve ball; and a probe section coupled to and positioned downhole of the travelling valve assembly, the probe section comprising a downward extending probe for engaging and unseating the valve ball of the standing valve assembly.

In some embodiments, the standing valve assembly comprises a stem extending upward from the flow cage, the stem having a length to engage and unseat the second valve ball of the travelling valve assembly when the probe engages the valve ball of the standing valve assembly.

In some embodiments, a distal tip of the probe has a curved profile.

According to an aspect, there is provided a method for a downhole artificial lift system comprising the standing valve assembly as described herein, comprising: receiving a probe through one of the openings to the fluid passage; and engaging and unseating the valve ball with the probe.

In some embodiments, receiving the probe through the one of the openings comprises guiding the probe into the opening by a guide ramp of the at least one guide ramp.

Other aspects and features of the present disclosure will become apparent, to those ordinarily skilled in the art, upon review of the following description of the specific embodiments of the disclosure.

BRIEF DESCRIPTION OF THE DRAWINGS

The present disclosure will be better understood having regard to the drawings in which.

DETAILED DESCRIPTION

In this disclosure, the term "upward" may be used to refer to the "uphole" direction, where the "uphole" direction refers to the direction toward the surface in a well or borehole. The term "downward" may be used to refer to the "downhole" direction, where the "downhole" direction refers to the direction toward the bottom of the well or borehole (i.e. opposite to the uphole direction). The terms "above" and "below" as used herein may also likewise refer to relative position of one element uphole or downhole of another element respectively. These terms are not limited to elements arranged in vertical orientations (e.g. in lateral or horizontal wellbores).

The term "downhole pump" refers to any pumping system positioned within a well or borehole for pumping fluids or other materials to the surface. The term "reciprocating downhole pump" refers to any pump system in which one or more components reciprocates within the well for moving fluids or other materials uphole, such as a downhole pump comprising a reciprocating plunger in a barrel.

The term "standing valve" refers to a valve positioned at or near the bottom of the barrel or corresponding structure of the downhole pump. The term "travelling valve" refers to a valve that travels with the plunger or other reciprocating component of the downhole pump.

Figure 1:
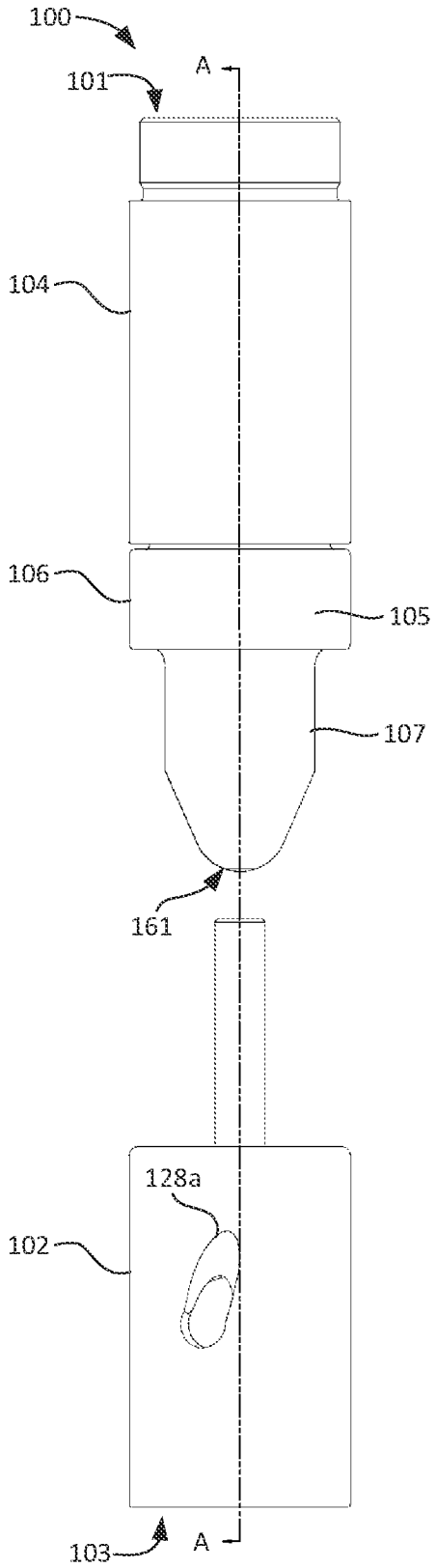
FIG. 1 is a side view of a valve system for a reciprocating downhole pump, in a first configuration, according to some embodiments.
Figure 2:
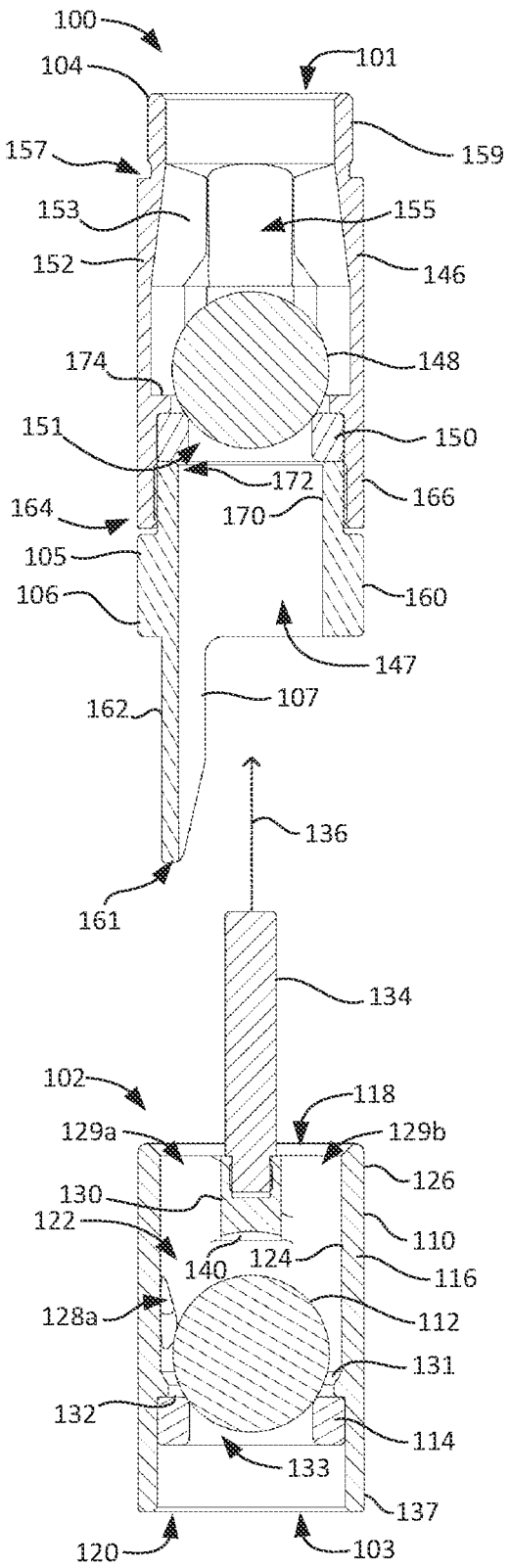
FIG. 2 is a cross-sectional view of the valve system taken along the line A-A in FIG. 1.

FIG. 1 is a side view of a valve system 100 for a reciprocating downhole pump, in a first configuration, according to some embodiments. FIG. 2 is a cross-sectional view of the valve system 100 taken along the line A-A in FIG. 1.

Figure 3:
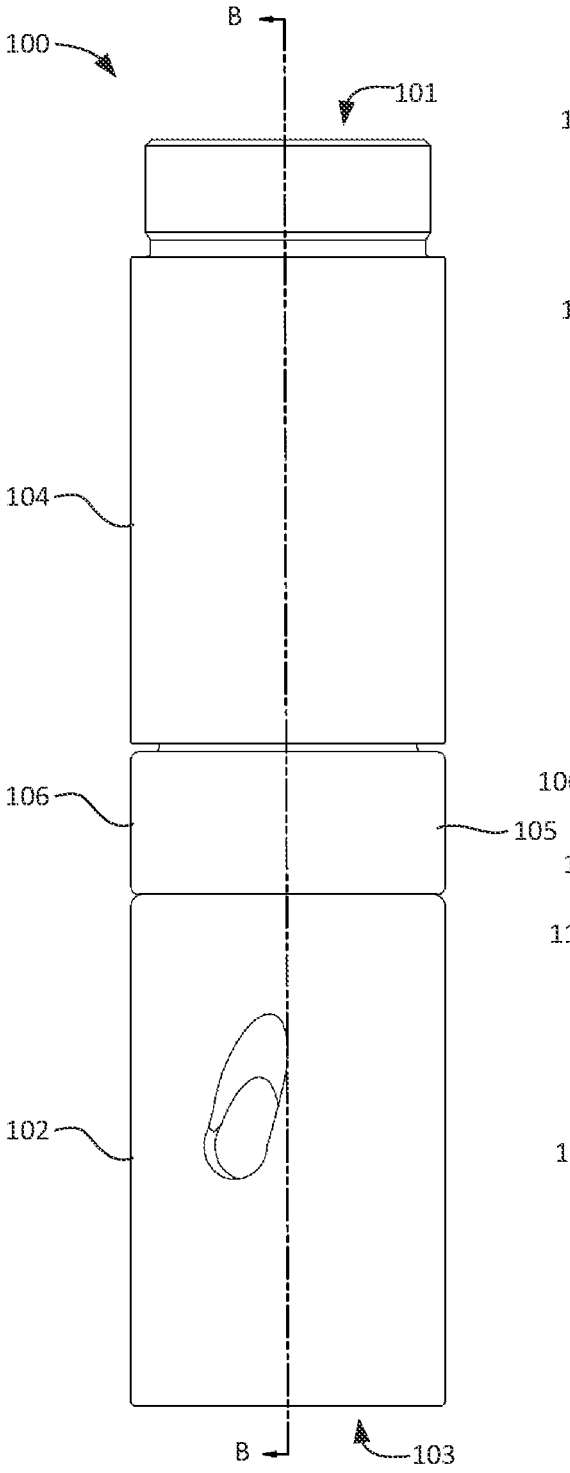
FIG. 3 is a side view of the valve system of FIG. 1 in a second configuration.
Figure 4:
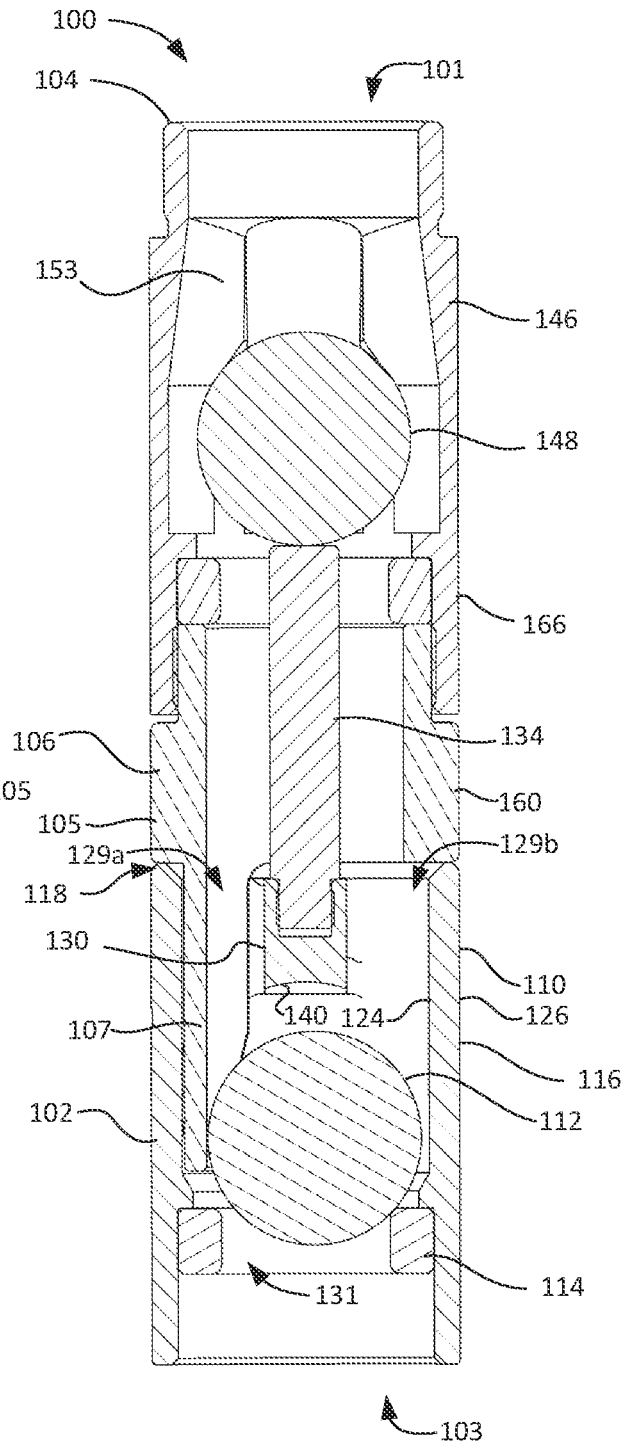
FIG. 4 is a cross-sectional view of the valve system taken along the line B-B in FIG. 3.

FIG. 3 is a side view of the valve system 100 of FIG. 1 in a second configuration. FIG. 4 is a cross-sectional view of the valve system 100 taken along the line B-B in FIG. 3.

Figure 12:
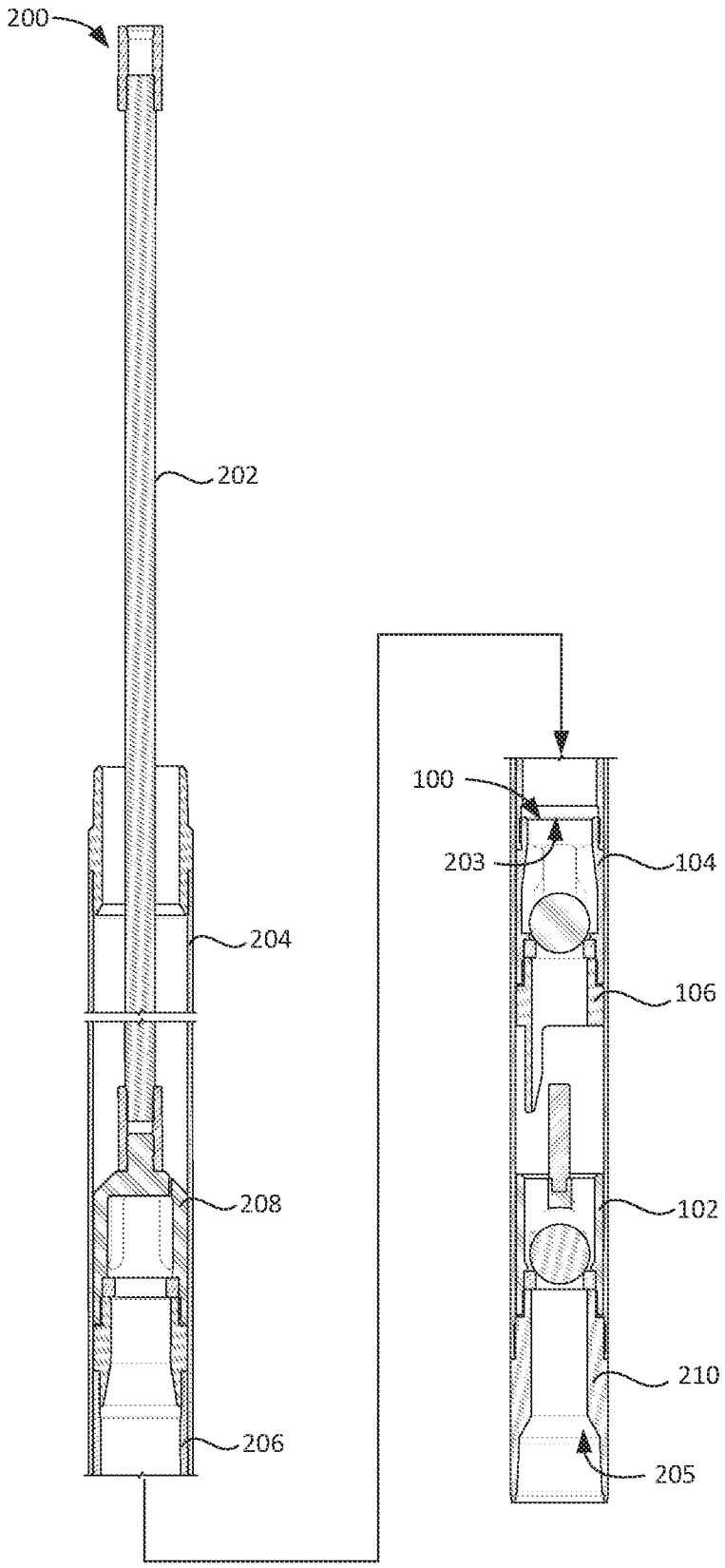
FIG. 12 is a cross-sectional view of the pump system taken along the line E-E in FIG. 11.
Figure 14:
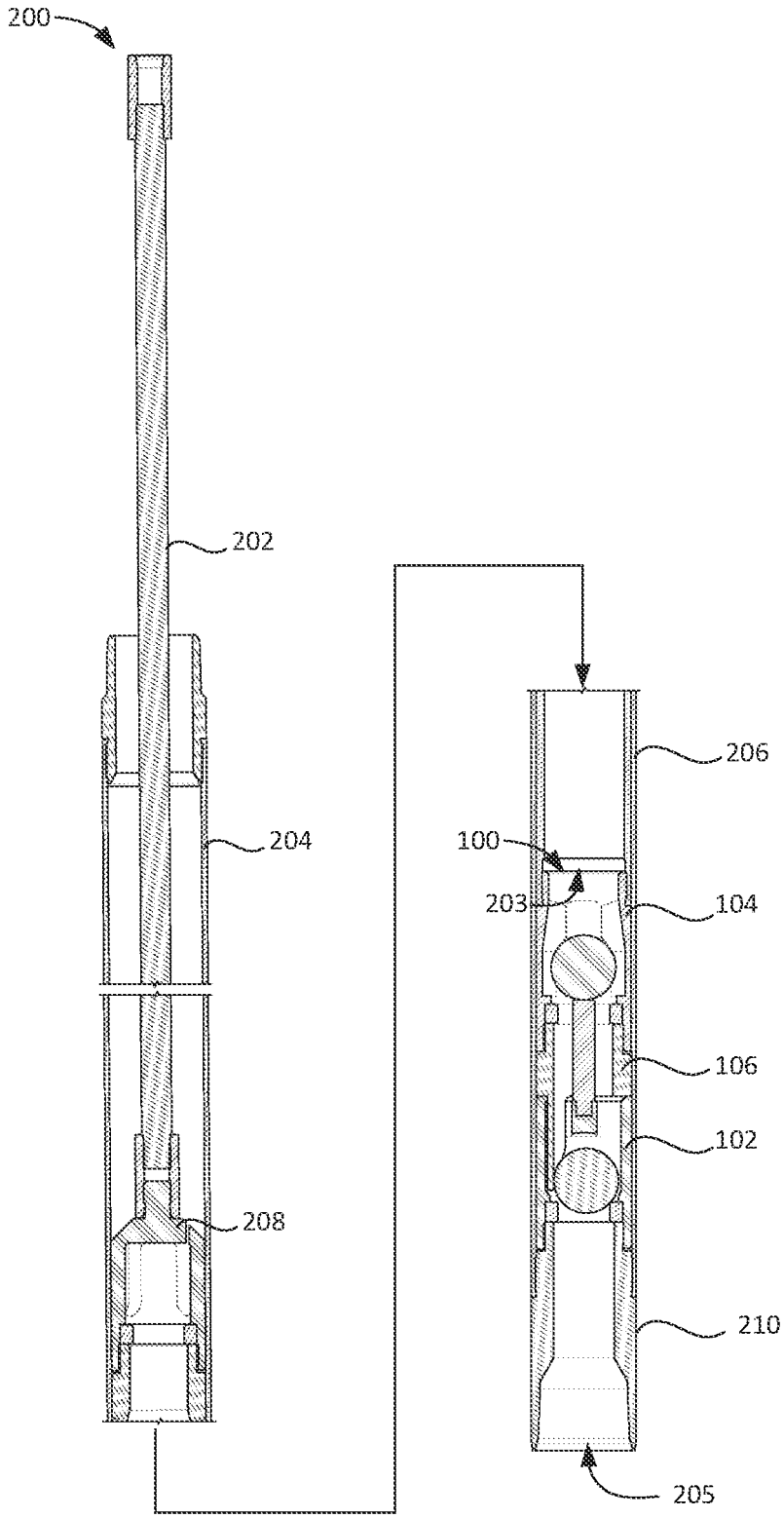
FIG. 14 is a cross-sectional view of the pump system taken along the line F-F in FIG. 13.

Referring to FIGS. 1 to 4, the valve system 100 includes a standing valve assembly 102, a travelling valve assembly 104 and a probe section 106. The valve system 100 as shown generally has an uphole end 101 and a downhole end 103. The standing valve assembly 102, the travelling valve assembly 104 and the probe section 106 are axially aligned and configured to be received in a barrel downhole (as shown in FIGS. 12 and 14). The outer diameters of the standing valve assembly 102, the travelling valve assembly 104 and the probe section 106 are selected to be smaller than the inner diameter of the barrel. In this example, the standing valve assembly 102, the travelling valve assembly 104 and the probe section 106 each have a similar outer diameter, such that when engaged as shown in FIGS. 3 and 4, the system 100 has a relatively flush outer surface substantially along its length. An annular gap may thereby be provided between the system 100 and the barrel.

The standing valve assembly 102 may be connected to a shoe at a bottom of the barrel. The travelling valve assembly 104 is positioned uphole of the standing valve assembly 102 and the probe section 106. The travelling valve assembly 104 may be connected to a bottom end of a plunger in the barrel (such as the plunger 206 shown in FIGS. 12 and 14). The probe section 106 is fixedly coupled to and positioned below the traveling valve assembly 104. The probe section 106 comprises a tubular main body 105 and a probe 107 extending downward from the main body 105 for engaging the standing valve assembly 102, as will be described in more detail below. The probe section 106 may be integral with the travelling valve assembly 104 in other embodiments.

In the first configuration of the system 100 shown in FIGS. 1 and 2, the travelling valve assembly 104 and the probe section 106 are disengaged and spaced from the standing valve assembly 102. This first configuration may correspond to a production mode, wherein the plunger (together with the travelling valve assembly 104 and the probe section 106) reciprocates in the barrel for pumping fluids to the earth's surface. In the second configuration of FIGS. 3 and 4, the travelling valve assembly 104 and the probe section 106 engage the standing valve assembly 102 to allow fluid draining or insertion functionality. These first and second configurations will be described in more detail below.

Referring to FIG. 2, the standing valve assembly 102 is in the form of a first ball check valve comprising a standing flow cage 110, a first valve ball 112 and a first ball seat 114. The standing flow cage 110 has an upper end 118 and a bottom end 120 and comprises a generally tubular body 116. The upper end 118 is an outlet end, and the lower end 120 is an inlet end in this embodiment. The tubular body 116 defines an axial bore 122 therethrough (from the upper end 118 to the lower end 120) and has an inner surface 124 and an outer surface 126. Embodiments are not limited to tubular flow cages, and the standing flow cage 110 may comprise a non-tubular body, such as a body comprising a series of connected ribs in other embodiments. Embodiments are also not necessarily limited to vertically aligned axial bores as the fluid passage through the flow cage.

The tubular body 116 in this embodiment defines first side port 128*a* and second side port 128*b* therethrough, which each extend from the inner surface 124 to the outer surface 126. The second side port 128*b* is visible in FIG. 5. Embodiments are not limited to a particular number, shape, or configuration of ports. For example, the flow cage 110 may include three or more ports in other embodiments. Such ports may be omitted in other embodiments.

The standing flow cage 110 further comprises a bridge 130 extending across the axial bore 122 of the tubular body 116. The bridge 130 is positioned at the upper end 118 of the standing flow cage 110. The bridge 130 and the inner surface 124 of the tubular body 116 define first opening 129*a* and second opening 129*b* to the axial bore 122 in the upper end 118 of the standing flow cage 110. The openings 129*a* and 129*b* are on opposite sides of the bridge 130 in this embodiment.

The ball seat 114 is positioned below and spaced apart from the bridge 130, proximate the lower end 120. The ball seat 114 in this embodiment ring-shaped, defining a central hole 133 or opening therethrough and having an outer diameter complimentary to the inner diameter of the tubular body 116. When seated, the ball 112 blocks the central hole 133 of the ball seat 114, thereby preventing fluid flow through the standing flow cage 110. Thus, when downward pressure causes the valve ball 112 to be landed and held on the ball seat 114 (e.g. during the downstroke), the valve ball 112 blocks fluid flow in the downhole direction. When the pressure differential is reversed (e.g. during the upstroke), the valve ball 112 is raised from the ball seat 114, allowing upward flow of fluid through the standing valve assembly 102.

In this embodiment, the inner surface 124 of the tubular body 116 defines an inner annular ridge 131 that is spaced axially below the bridge 130. The ridge 131 defines a lower annular shoulder 132 (underside of the ridge 131), and the ball seat 114 abuts the lower annular shoulder 132. The seat may be held in place by a seat plug or seat bushing (not shown) that is screwed in with a tight fit or otherwise coupled below the seat. In other embodiments, the ball seat 114 may be integral with the standing flow cage 110. Embodiments are not limited to any particular method of securing the ball seat in position.

The valve ball 112 is positioned within the axial bore 122 of the tubular body 116 and positioned axially intermediate the ball seat 114 and the bridge 130. The bridge 130 and ball seat 114 are spaced to allow limited axial movement of the ball 112 therebetween, with the ball seat 114 functioning as a lower axial stop and the bridge 130 functioning as an upper stop.

The standing valve assembly 102 in this embodiment further comprises a stem 134 that extends upward toward the traveling valve assembly 104 from the upper end 118 of the standing flow cage 110. Specifically, in this embodiment, the stem 134 extends upward from the bridge 130 and is aligned with a central longitudinal axis 136 of the standing valve assembly 102.

The standing valve assembly 102 further comprises a lower attachment portion 137 its lower end 120 for connecting to a shoe, bushing, or other component proximate the bottom of the barrel (e.g. via threaded connection).

Figure 5:
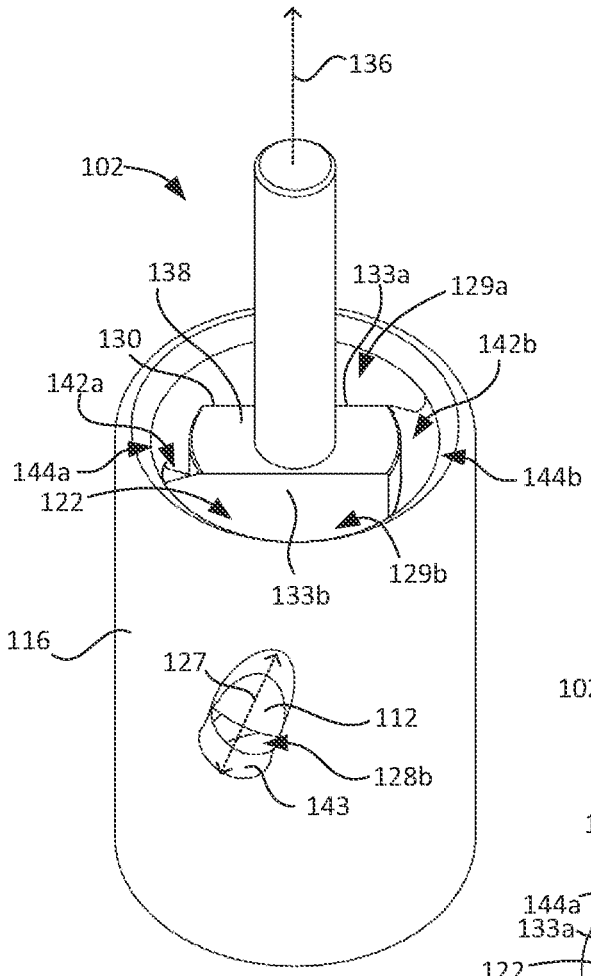
FIG. 5 is an upper perspective view of a standing valve assembly of the system of FIGS. 1 to 4 in isolation, according to some embodiments.
Figure 6:
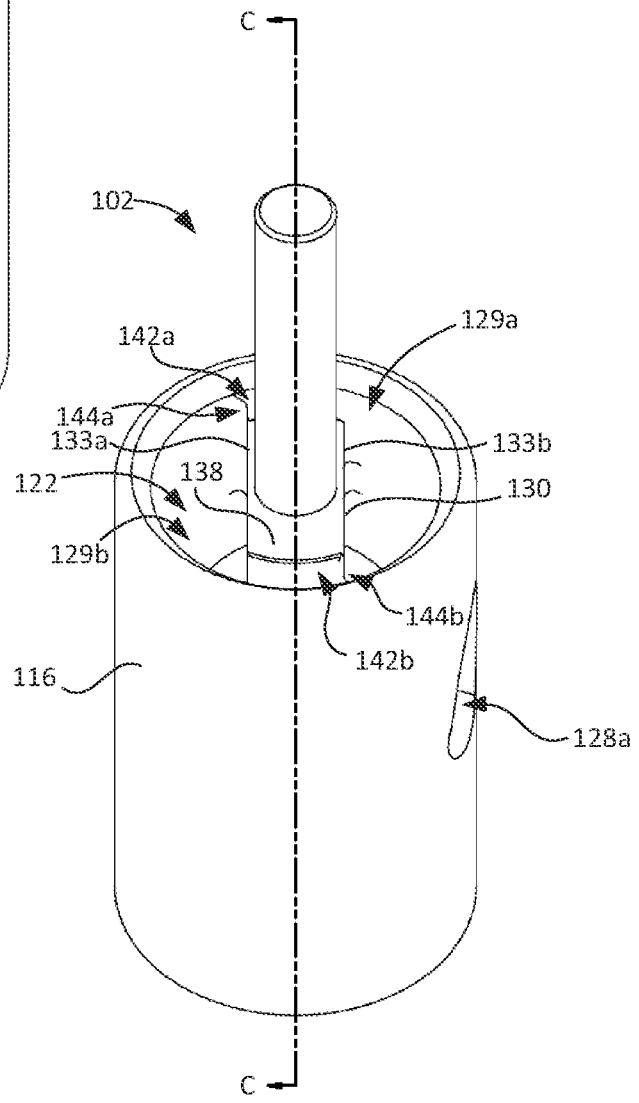
FIG. 6 is an upper perspective view of the standing valve assembly that is rotated 90 degrees relative to the view of FIG. 5.

FIG. 5 is an upper perspective view of the standing valve assembly 102 in isolation. FIG. 6 is an upper perspective view of the standing valve assembly 102 that is rotated 90 degrees relative to the view of FIG. 5.

As shown in FIGS. 5 and 6, the bridge 130 in this embodiment is in the form of a beam extending across the axial bore 122, although embodiments are not limited to particular shape of the bridge 130. For example, in other embodiments, the bridge may be a cross piece that defines three or more openings at the upper end of the flow cage.

The bridge 130 in this example has an upper face 138 and a lower face 140 (visible in FIG. 2). The bridge 130 defines a first guide ramp 142*a* and second guide ramp 142*b* recessed into the upper face 138. The guide ramps 142*a* and 142*b* extend the full width of the bridge 130 and are downward angled in a rotational or tangential direction relative to the longitudinal axis 136. The first guide ramp 142*a* is recessed into the upper face 138 at a first end 144*a* of the bridge 130, and the second guide ramp 142*b* is recessed into the upper face 138 at a second end 144*b* of the bridge 130. The first guide ramp 142*a* and the second guide ramp 142*b* each extend at the downward angle toward a respective one of the openings 129*a* and 129*b* in the standing flow cage 110. The first guide ramp 142*a* and the second guide ramp 142*b* are adjacent the tubular body 116. As will be described in more detail below, the guide ramps 142*a* and 142*b* may help guide the probe 107 of the probe section 106 to properly engage the valve ball 112. The guide ramps 142*a* and 142*b* may extend across the entire width of the bridge 130 as shown in FIGS. 5 and 6 (i.e. from a first side 133*a* of the bridge 130 to an opposite second side 133*b*).

In this example embodiment, the first side port 128*a* and the second side port 128*b* are in the form of slots with elongated, oblong profiles. The ports 128*a* and 128*b* are elongated along a generally helical path. In other words, the ports 128*a* and 128*b* are each elongated in a direction, indicated by arrow 127, that is angled with respect to the longitudinal axis 136 of the flow cage 110). The specific oblong shape in this non-limiting example is a circular profile cut or drilled into the tubular body 116 and then extended along the helical path. In other embodiments, the ports 128*a* and 128*b* may have circular or elliptical profiles.

For example, the ports may optionally have an elliptical profile with a major axis of the ellipse being angled with respect to the longitudinal axis 136. The angled, elongated configuration of the ports may help prevent or reduce eddy currents that reduce pressure drop.

The first side port 128*a* and the second side port 128*b* are opposite to each other and angled in the same rotational direction with respect to the longitudinal axis 136 (such that, from a side view of the standing valve assembly 102, the ports 128*a* and 128*b* appear to be angled in opposite directions). The first side port 128*a* and the second side port 128*b* may each extend through the tubular body 116 at an angle and position that aligns with the angle and position of the corresponding guide ramp 142*a* or 142*b*. For example, the side wall 143 of the second side port 128*b* may be aligned with the second guide ramp 142*b*.

Embodiments are not limited to the specific standing valve assembly 102. Other embodiments may, for example, include a generally tubular body with at least one flow cage insert received therein.

Turning again to FIG. 2, the travelling valve assembly 104 in this embodiment is a ball check valve comprising a travelling flow cage 146, a second valve ball 148, and a second ball seat 150. The travelling flow cage 146 is in the form of a tubular body 152. The valve ball 148 sits above the ball seat 150 in the travelling flow cage 146. The ball seat 150 is ring-shaped in this embodiment with a central opening 151 therethrough, although embodiments are not limited to a particular ball seat or travelling valve configuration. When downward pressure causes the valve ball 148 to be seated on the ball seat 150 (e.g. in the upstroke), the valve ball 148 blocks fluid flow in the downhole direction. When the pressure differential is reversed (e.g. in the downstroke), the valve ball 148 is raised from the ball seat 150, allowing upward flow of fluid through the travelling valve assembly 104.

The tubular body 152 defines an inner annular ring 174 near, but spaced upward from a downhole end 164 of the body 152. The ball seat is received in the tubular body 152 below and abutting an underside (or lower shoulder) of the inner annular ring 174.

The traveling valve assembly further comprises an upper connector portion 159 at the top end of the assembly 104 for connecting to the bottom of a plunger, or to another component such as a bushing between the plunger and the travelling valve assembly (e.g. via threaded connection). Narrowing inner ribs 153 extend inward on the interior 155 of the travelling flow cage 146 in its upper region 157. The ribs 153 act as an upper stop to limit upward axial movement of the valve ball 148, while still allowing flow of fluid therethrough.

The probe section 106 generally comprises a collar 160 and the probe 107 extends downward from the collar 160. The probe 107 is positioned radially inward from the outer periphery of the collar 160 such that a radially outer surface 162 of the probe is disposed inward relative to the inner surface 124 of the tubular body 116 of the standing valve assembly 102. The probe 107 may thereby be axially aligned with of the openings 129*a* or 129*b* of the standing flow cage 110. The collar 160, the ball seat 150 and the travelling flow cage 146 of the travelling valve assembly collectively define an axial fluid passage 147 therethrough that is generally aligned with the axial bore 122 of the standing flow cage 110 of the standing valve assembly 102.

The probe 107 in this example is in the form of a downward extending projection with a flattened shape (i.e. flange-shaped) with an outer surface curvature that is generally complementary to the inner surface 124 of the standing flow cage 110. The probe 107 also has a curved distal end or tip 161. The curved profile of the curved tip may extend in a rotational or tangential direction relative to the longitudinal axis 136 such that the curved tip 161 may be more likely to be guided by the guide ramps 142*a* and 142*b* when the tip 161 is incident on one of the guide ramps 142*a* or 142*b*.

Embodiments are not limited to the particular probe section 106 of this embodiment. For example, a probe may extend directly from the travelling valve assembly.

The probe section 106 is fixedly coupled to a downhole end 164 the travelling valve assembly 104. The probe section 106 may be connected to the travelling valve assembly 104 in any suitable manner. In this example, the travelling valve assembly includes a first attachment portion 166 with inner threads (not shown) at its downhole end 164, and the probe section 106 comprises a second attachment portion 170 with outer threads (not shown) at its uphole end 172. The outer threads of the second attachment portion 170 engage the inner threads of the first attachment portion 166 to couple the probe section 106 to the travelling valve assembly 104.

The second attachment portion 170 of the probe section 106 abuts the ball seat 150 of the travelling valve assembly 104. The ball seat 150 is held axially between the second attachment portion 170 and the inner annular ring 174 defined by the tubular body 152. Thus, the ball seat 150 is axially secured between the inner annular ring 174 of the tubular body 152 and the second attachment portion 170 of the probe section 106. In other embodiments, the ball seat 150 may be formed integrally with the tubular body 152.

In operation, the system 100 may be in the first configuration shown in FIG. 2, for fluid production. For production of fluids, the valve balls 112 and 148 are able to move axially within the flow cages 110 and 146 as dictated by the pressure differentials. In this configuration, the travelling valve assembly 104 and probe section 106 may reciprocate together with the plunger and may be spaced sufficiently from the standing valve assembly 102 to be able to move through the full upstroke and downstroke motions. For the downstroke, the standing valve assembly 102 is closed (i.e. the valve ball 112 is seated) and the travelling valve assembly 104 is open (i.e. the valve ball 148 is not seated) to allow upward fluid flow through the travelling valve assembly 104 into the plunger. For the upstroke, the standing valve assembly 102 is open to allow fluid to flow into the barrel, and the travelling valve assembly 104 is closed such that fluid above the travelling valve assembly 104 is moved uphole.

The ports 128*a* and 128*b* may provide a beneficial flow path for fluids being pumped through the standing valve assembly 102. The pressure drop through a standing valve may typically be significantly higher than the pressure drop through a traveling valve. Increased pressure drop may cause heavy asphalt precipitation and or increase paraffin wax and scale issues. The flow area through the standing flow cage 110 in this embodiment may reduce or mitigate the pressure drop through the standing flow cage 110. A lower pressure drop across the standing valve assembly 102 may increase pump fillage every stroke during production, thereby increasing the pumping efficiency and production rate through the pump. The lower pressure drop may also reduce risk of jetting through the system 100 with steam. An operator may, thereby, be able increase the life of the pump with lower pressure drop during production and increase their pump efficiency and pump fillage.

During the upstroke, upward fluid flow through the standing valve assembly 102 may pin the valve ball 112 against the lower face 140 of the bridge 130. In conventional ball check valves, high production rates may cause the valve ball to vibrate in the flow cage due to fluid flows, which can cause wear over time. The standing valve assembly 102 of the present embodiment may reduce or prevent such vibration.

Figure 7:
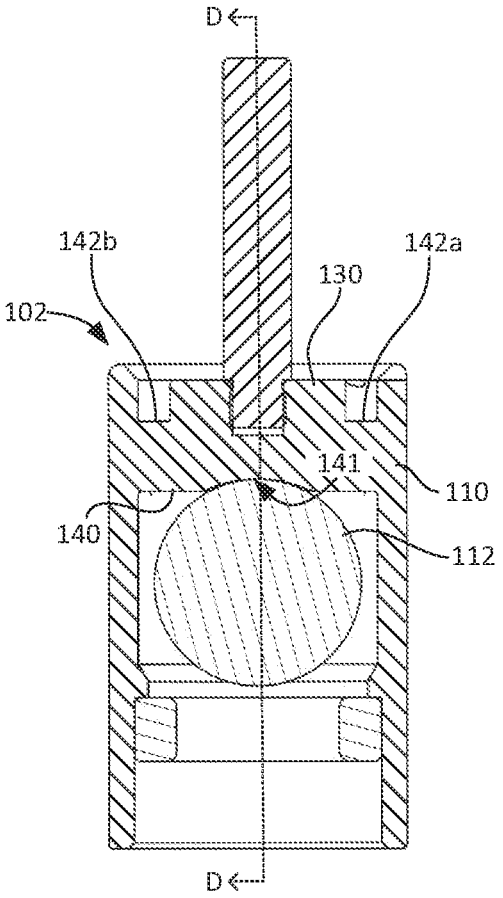
FIG. 7 is a cross-sectional view of the standing valve assembly taken along the line C-C in FIG. 6 and showing the valve ball in an unseated position.
Figure 8:
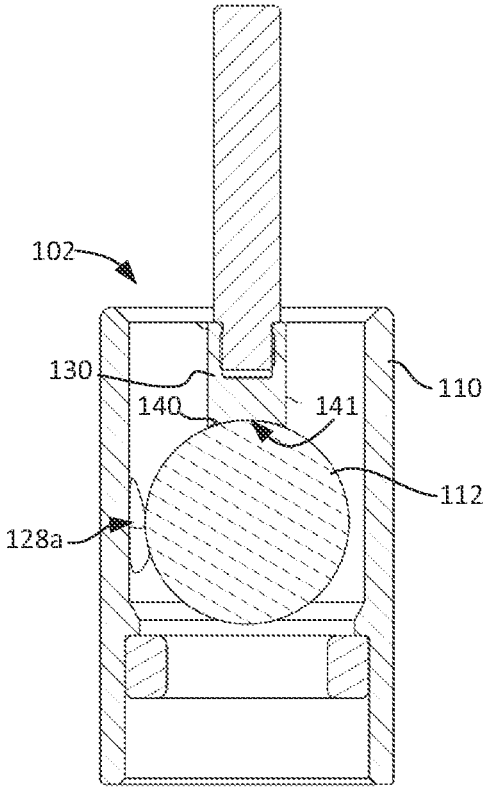
FIG. 8 is a cross-sectional view of the standing valve assembly taken along the line D-D in FIG. 7.

FIG. 7 is a cross-sectional view of the standing valve assembly taken along the line C-C in FIG. 6. FIG. 8 is a cross-sectional view of the standing valve assembly taken along the line D-D in FIG. 7. In FIGS. 7 and 8, the ball 112 is shown unseated and pushed up against the lower face 140 of the bridge 130. As shown, the lower face 140 of the bridge 130 defines a curved recess 141 that is shaped complementary to the outer curvature of the ball 112. The recess 141 may help stabilize the ball 112 during the upstroke.

Furthermore, the elongate, oblong shape and angled arrangement of two ports 128*a* and 128*b* may cause perpendicular parabolic fluid velocity profiles which are synergistic to the openings 129*a* and 129*b* between the bridge 130 acting as the upper stop for the valve ball 112. The fluid velocity profile may thereby be optimized in the smallest cross-sectional area of the fluid flow. In this example, approximately the lower quarter of the ball 112 is exposed to the exterior of the standing flow cage 110 through the ports 128*a* and 128*b*. In other embodiments, the ports 128*a* and 128*b* may be further elongated such that, with the ball 112 pinned against the bridge 130, the ports 128*a* and 128*b* may extend from just below the ball 112 to approximately the middle of the ball 112. Embodiments are not limited to particular dimensions of the ports 128*a* and 128*b*.

The perpendicular parabolic fluid velocity profiles may pin the ball 112 up against the bridge 130 during production after injection. The ball 112 may thereby be held in the recess 141 in the lower face 140 of the bridge. The parabolic fluid velocity profiles may prevent or reduce lateral movement or vibration of the ball 112.

The system 100 is also operable in the second configuration shown in FIGS. 3 and 4, in which the probe section 106 and the travelling valve assembly 104 are engaged with the standing valve assembly 102. In this configuration, both the travelling valve assembly 104 and the standing valve assembly 102 may be held in an open position to allow fluid to pass through the system 100. For example, this configuration may be used for draining fluids and/or for steam injection.

To move the system 100 from the first configuration of FIGS. 1 and 2 to the second configuration shown in FIGS. 3 and 4, the traveling valve assembly 104 and the probe section 106 may be lowered until the probe section 106 is landed on the standing flow cage 110. The probe 107 may pass through one of the openings 129*a* and 129*b* in the standing flow cage 110 to engage the valve ball 112 of the standing valve assembly 102. In some cases, the probe 107 may be at least partially axially aligned with the bridge 130. Thus, when lowered, the probe 107 may contact the bridge 130. The guide ramps 142*a* and 142*b* are positioned such that the probe 107 may be incident one of the guide ramps 142*a* and 142*b* in this scenario, with the corresponding guide ramp 142*a* or 142*b* guiding the probe 107 to the corresponding opening 129*a* or 129*b*. The system 100 may, thus, be self-aligning in this respect, and the guide ramps 142*a* and 142*b* may thereby reduce the likelihood of the probe 107 becoming stuck on the standing flow cage 110. Damage to the standing flow cage 110 may also be mitigated or avoided.

With reference to FIG. 4, the probe section 106 and the travelling valve assembly 104 are lowered such that the collar 160 of the probe section abuts the upper end 118 of the standing flow cage 110. The probe 107 extends down through opening 129*a* of the standing flow cage 110 and engages a side of the valve ball 112. The probe 107 pushes the valve ball 112 to the side which unseats the valve ball 112 from the ball seat 114 such that the central hole 133 in the ball seat 114 is not blocked. Fluid may, thus, flow through the standing valve assembly 102.

At the same time, the stem 134 of the standing valve assembly 102 extends upward through the opening 151 in the ball seat 150 of the traveling valve assembly 104. The stem pushes the valve ball 148 of the travelling valve assembly 104 upward, thereby unseating the valve ball 148 and allowing fluid to flow through the travelling valve assembly 104.

In conventional oversized pumps, a surge pressure may be created above the pump since the internal diameter of the pump may be much greater than that of the tubing. This surge pressure may cause a tubing drain, such as a rupture disk tubing drain, to fail prematurely. In the embodiment of FIGS. 3 and 4, by opening both valves assemblies 102 and 106, fluid in the tubing may be allowed to drain downhole through the system 100, thereby obviating the need for a different tubing drain mechanism.

This second configuration shown in FIGS. 3 and 4 may be also be used, for example, for steam insertion into a reservoir. An operator will be able to move the travelling valve assembly 104 and probe section 106 to the configuration shown in FIGS. 3 and 4 to open both check valves and allow steam to be injected through the pump into their reservoir. This may be done without having to pull the pump (including the system 100) and run the pump back in the hole to steam the reservoir. For example, a pump including the system 100 and rods may be run in on the steam string and steam may be injected through the pump into the reservoir. Once the steam cycle is complete the producer may be able to hook up to the rods with a surface pumping unit. The system 100 may be moved to the first configuration shown in FIGS. 1 and 2 for the pumping of production fluids uphole. The decrease in time lag to from steam cycle completion to making oil may be a big cost saving for the producer. The configuration shown in FIGS. 3 and 4 may be also be used, for example, to flush fluid into a tail pipe that is attached to the bottom of the pump to deepen the intake of the pumping system. An operator may move the travelling valve assembly 104 and probe section 106 to the configuration shown in FIGS. 3 and 4 to open both check valves and allow fluid to be pushed into the tail section in the event of the tail section has becoming plugged.

Figure 9:
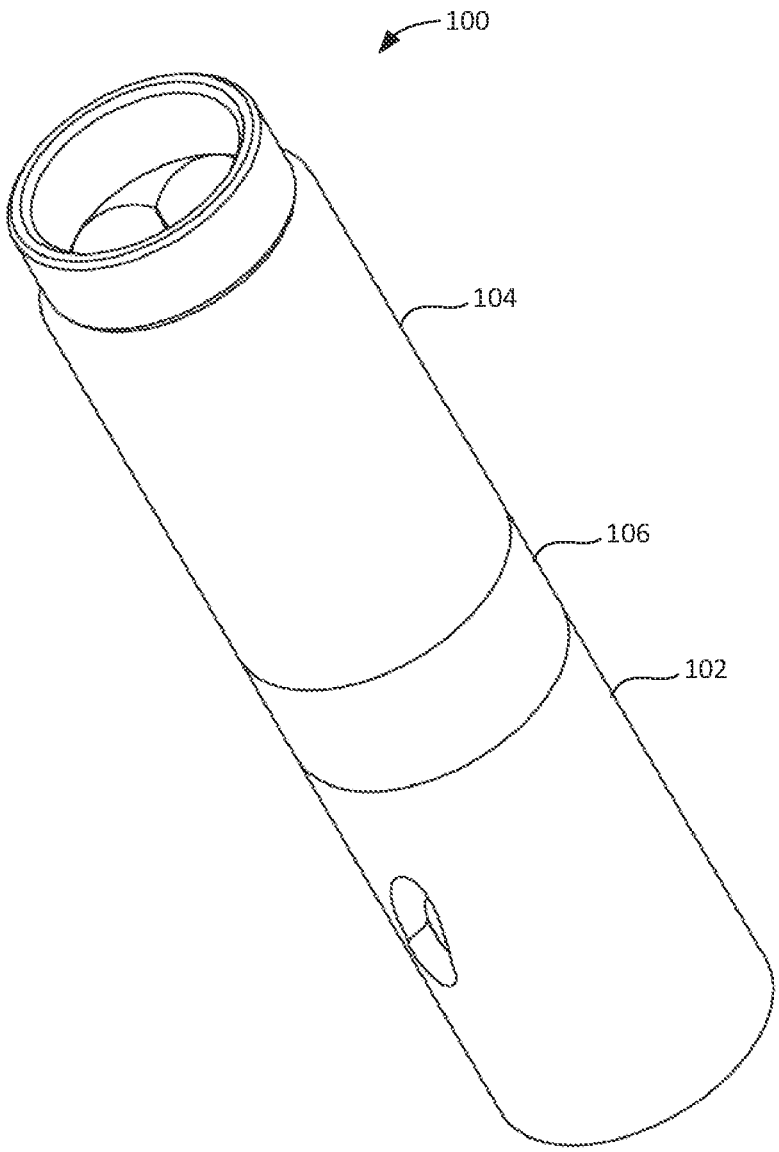
FIG. 9 is an upper perspective view of the system of FIGS. 1 to 4 in the second configuration of FIGS. 3 and 4.

FIG. 9 is an upper perspective view of the system 100 in the second configuration of FIGS. 3 and 4. As shown, the outer surfaces of the standing valve assembly 102 is positioned abutting the probe section 106. The standing valve assembly 102, the travelling valve assembly 104, and the probe section 106 collectively form a pass through apparatus in this configuration, by which fluid may be drained from the barrel and/or steam may be passed through downhole for injection into a reservoir. Embodiments are not limited to a specific use of the system 100.

Figure 10:
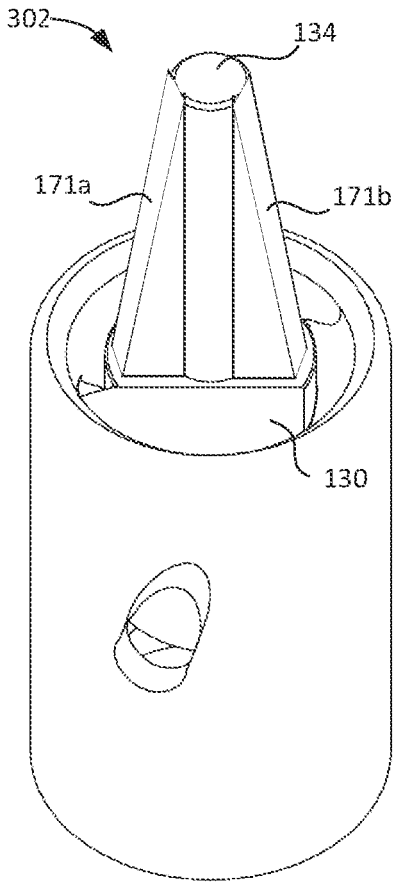
FIG. 10 is an upper perspective view of a modified embodiment of the standing valve assembly of FIGS. 5 to 8.

FIG. 10 is an upper perspective view of an alternative embodiment of a standing valve assembly 302. In FIG. 10, the standing valve assembly 302 is similar to the example shown in FIGS. 1 to 9, but is also provided with angular supports 171*a* and 171*b* on opposite sides of the stem 134. The angular supports 171*a* and 171*b* may provide structural support to the stem 134.

Figure 11:
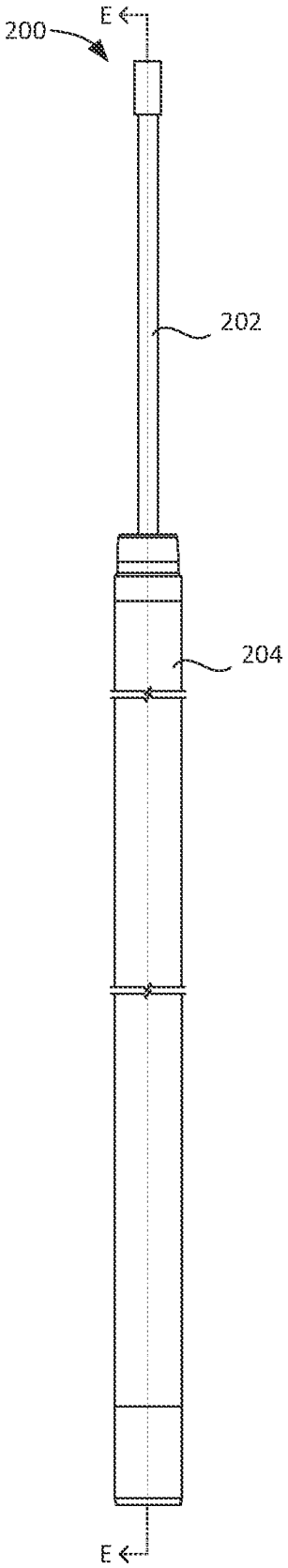
FIG. 11 is a side view of an example pump system according to some embodiments in a first configuration.
Figure 13:
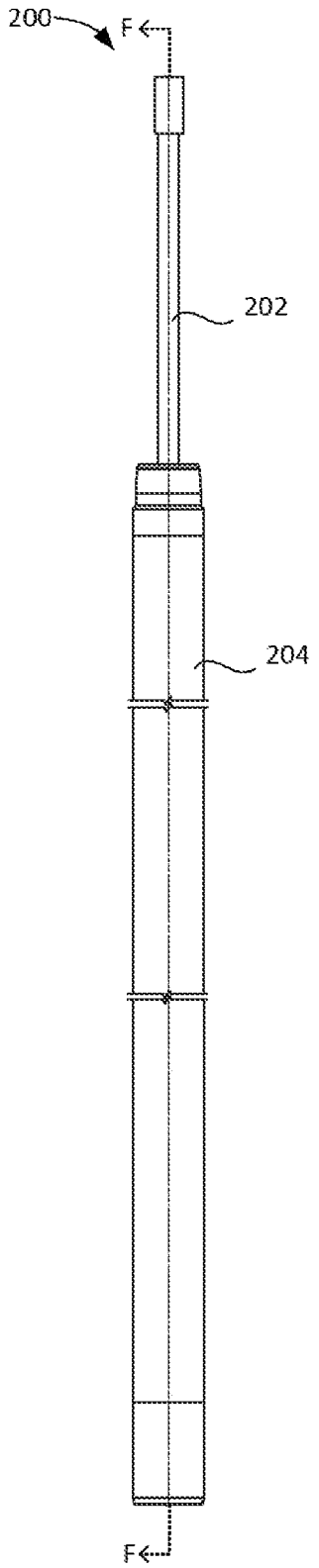
FIG. 13 is a side view of the pump system of FIGS. 11 and 12 in a second configuration.

An example reciprocal downhole pump system 200 including the valve system 100 of FIGS. 1 to 4 will now be described with reference to FIGS. 11 to 14. FIG. 11 is a side view of the pump system 200 according to some embodiments in a first configuration. FIG. 12 is a cross-sectional view of the pump system 200 taken along the line E-E in FIG. 11. FIG. 13 is a side view of the pump system 200 in a second configuration. FIG. 14 is a cross-sectional view of the pump system taken along the line F-F in FIG. 13.

The pump system 200 includes a valve rod (or pull rod) 202 and a barrel 204 that would be positioned in a wellbore (not shown). As shown in FIGS. 12 and 14, the system 200 further includes a plunger 206 and the valve system 100 of FIGS. 1 to 4. The valve rod 202 is coupled to the uphole end of the plunger 206 (e.g. by an adaptor 208). The valve rod 202 and plunger 206 reciprocate as actuated by a pump jack or other surface equipment (not shown). The valve rod 202 may be attached at its upper end to a sucker rod string.

The travelling valve assembly 104 is coupled to a downhole end 203 of the plunger 206. The standing valve assembly 102 is coupled to a shoe 210 or other equipment at a downhole end 205 (i.e. bottom) of the barrel 204.

FIGS. 11 and 12 show the system 200 in the first configuration that is similar to the configuration of FIGS. 1 and 2. Namely, the travelling valve assembly 104 and the probe section 106 are disengaged from the standing valve assembly 102. The plunger 206 may reciprocate together with the sucker rod 202, the travelling valve assembly 104 and the probe section 106 in order to move fluids to the surface.

FIGS. 13 and 14 show the system 200 in the second configuration that is similar to the configuration of FIGS. 3 and 4. Namely, the travelling valve assembly 104 and the probe section 106 are engaged with the standing valve assembly 102 such that the travelling valve assembly 104 and the standing valve assembly 102 are both open. Liquids or gasses such as steam or other fluids may flow downhole through the valve system 100.

Figure 15:
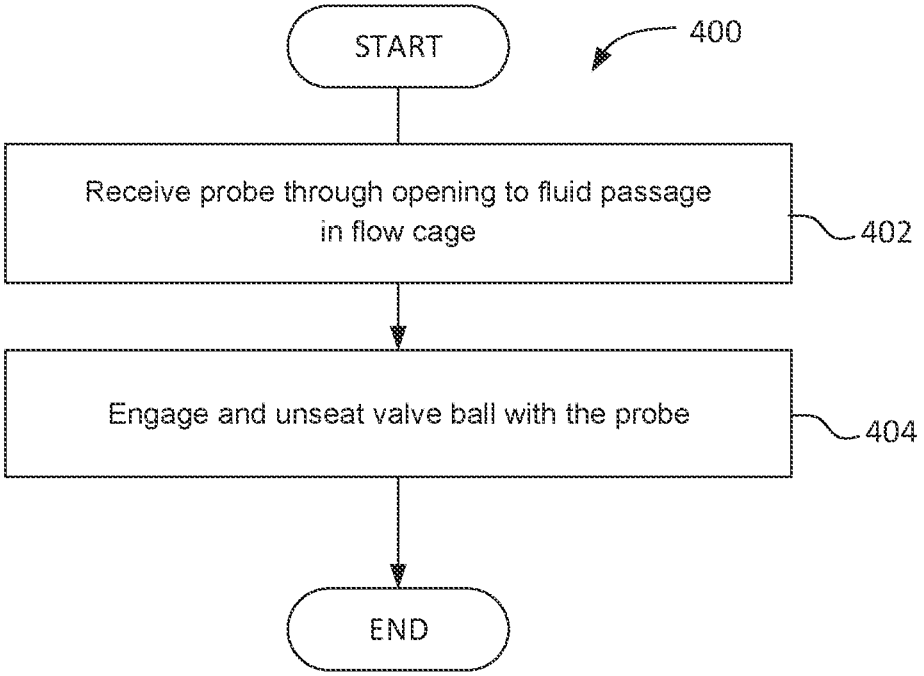
FIG. 15 is a flowchart of a method according to some embodiments.

FIG. 15 is a flowchart of a method 400 for an artificial lift system. The artificial lift system may include the valve system 100, including the travelling valve assembly 104, the probe section 106 and the standing valve assembly 102 or 302 of FIGS. 1 to 14.

At block 402, a probe is received through an opening to the fluid passage of the standing valve assembly. The probe may be in the form of the probe 107 shown in FIGS. 1, 2 and 4. The opening may be one of the openings 129*a* and 129*b* of the standing valve assembly 102 shown in FIGS. 2 and 4. In some embodiments, receiving the probe through the one of the openings comprises guiding the probe into the opening by a guide ramp of the at least one guide ramp.

At block 404, the probe engages the valve ball of the standing valve assembly to unseat the valve ball. Optionally, with the valve ball unseated, fluid is drained through the standing valve assembly, or steam is injected through the standing valve assembly. The method may also include performing any other operational steps or functions of the system described herein.

It is to be understood that a combination of more than one of the approaches described above may be implemented. Embodiments are not limited to any particular one or more of the approaches, methods or apparatuses disclosed herein. One skilled in the art will appreciate that variations, alterations of the embodiments described herein may be made in various implementations without departing from the scope of the claims.

The invention claimed is:

1. A standing valve assembly for a downhole artificial lift system, the standing valve assembly comprising:

a flow cage having a longitudinal axis and comprising:

a tubular cage body defining an axial fluid passage therethrough; and a bridge extending across the axial fluid passage, the tubular cage body and the bridge collectively defining a plurality of openings to the axial fluid passage;

a ball seat spaced from and positioned below the bridge; and a valve ball within the axial fluid passage and positioned between the ball seat and the bridge, the valve ball being removably seatable on the ball seat, wherein the bridge has an upper face, the upper face defining at least one guide ramp, each guide ramp extending, relative to the longitudinal axis, axially and tangentially at a downward angle to a respective one of the plurality of openings, the tubular cage body having an inner surface, and the at least one guide ramp being positioned radially inward of the inner surface of the tubular cage body.

2. The standing valve assembly of claim 1, wherein the tubular cage body comprises a tubular body, and the axial fluid passage comprises an axial bore through the tubular body.

3. The standing valve assembly of claim 2, wherein the tubular body has an inlet end and an outlet end, the bridge extends across the axial fluid passage proximate the outlet end, and the ball seat is positioned proximate the inlet end.

4. The standing valve assembly of claim 3, wherein the inlet end of the tubular body is a lower end of the tubular body, and the outlet end of the tubular body is an upper end of the tubular body.

5. The standing valve assembly of claim 4, wherein the ball seat and the bridge are spaced to allow limited axial movement of the valve ball, the bridge being an upper stop for the valve ball and the ball seat being a lower stop.

6. The standing valve assembly of claim 2, wherein the tubular body has an inner surface and an outer surface, and the tubular body defines a plurality of ports extending from the inner surface to the outer surface.

7. The standing valve assembly of claim 6, wherein the plurality of ports comprise at least a first port and a second port opposite to the first port.

8. The standing valve assembly of claim 6, wherein each of the plurality of ports has an oblong or elliptical profile that is elongated along a major axis that is angled relative to a longitudinal axis of the axial bore.

9. The standing valve assembly of claim 8, wherein each of the plurality of ports is elongated along a respective helical path.

10. The standing valve assembly of claim 1, wherein the ball seat defines a hole therethrough, the valve ball blocking flow through the hole when seated.

11. The standing valve assembly of claim 1, wherein the bridge comprises a beam having opposite first and second ends connected to the tubular cage body.

12. The standing valve assembly of claim 11, wherein the at least one guide ramp comprises a first guide ramp at the first end of the bridge and a second guide ramp at the second end of the bridge.

13. The standing valve assembly of claim 1, wherein each at least one guide ramp is angled to guide a downward extending probe, when the probe is incident on the guide ramp, into a respective one of the plurality of openings.

14. The standing valve assembly of claim 1, further comprising a stem extending upward from the upper end of the flow cage.

15. A system for a downhole reciprocating pump comprising:

the standing valve assembly of claim 1;

a travelling valve assembly comprising a second valve ball; and a probe section coupled to and positioned below the travelling valve assembly, the probe section comprising a probe, the probe extending axially downward, and the probe extending through one of the openings of the flow cage and engaging and unseating the valve ball of the standing valve assembly when the travelling valve assembly is in a lowered position.

16. The system of claim 15, wherein the standing valve assembly comprises a stem extending upward from the flow cage, the stem having a length to engage and unseat the second valve ball of the travelling valve assembly when the probe engages the valve ball of the standing valve assembly.

17. The system of claim 15, wherein a distal tip of the probe has a curved profile.

18. A method for operating the system of claim 15, comprising:

receiving the probe through one of the openings to the axial fluid passage; and engaging and unseating the valve ball with the probe.

19. The method of claim 18, wherein receiving the probe through the one of the openings comprises guiding the probe into the opening by a guide ramp of the at least one guide ramp.

20. The standing valve assembly of claim 1, wherein the bridge has a width tangential to the longitudinal axis, and the guide ramp extends fully across the width of the bridge.

* * * * *